US011814216B2

(12) United States Patent
Jung

(10) Patent No.: US 11,814,216 B2
(45) Date of Patent: Nov. 14, 2023

(54) CONTAINER WHOSE HINGE PART IS HIDDEN FROM OUTSIDE

(71) Applicant: YONWOO CO., LTD., Incheon (KR)

(72) Inventor: Seo Hui Jung, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 17/902,768

(22) Filed: Sep. 2, 2022

(65) Prior Publication Data

US 2023/0040000 A1 Feb. 9, 2023

(30) Foreign Application Priority Data

Jul. 5, 2021 (KR) ..... 10-2021-0087839

(51) Int. Cl.

| | |
|---|---|
| ***B65D 43/16*** | (2006.01) |
| ***B65D 77/04*** | (2006.01) |
| ***A45D 40/22*** | (2006.01) |

(52) U.S. Cl.

CPC ..... *B65D 43/166* (2013.01); *A45D 40/221* (2013.01); *B65D 77/0486* (2013.01); *B65D 2543/00092* (2013.01); *B65D 2577/041* (2013.01)

(58) Field of Classification Search

CPC .... B65D 43/166; B65D 43/161; B65D 51/28; B65D 77/0486; B65D 2453/00092; B65D 2577/041; A45D 33/24; A45D 40/221; A45D 2040/225; E05D 3/18; E05D 15/30

See application file for complete search history.

(56) References Cited

U.S. PATENT DOCUMENTS

| | | | | |
|---|---|---|---|---|
| 2,001,356 A * | 5/1935 | Bates | E05D 3/18 16/370 |
| 3,788,514 A * | 1/1974 | Giacoma, Jr. | B65D 51/16 137/67 |
| 4,746,031 A * | 5/1988 | Grandmottet | A45D 40/22 220/836 |
| 4,880,139 A * | 11/1989 | Jumel | A45D 40/221 206/581 |
| 5,107,871 A * | 4/1992 | Butcher | A45D 40/22 206/823 |

(Continued)

FOREIGN PATENT DOCUMENTS

| | | |
|---|---|---|
| FR | 2931641 A1 | 12/2009 |
| JP | S6097510 U | 7/1985 |

(Continued)

*Primary Examiner* — Chun Hoi Cheung
*Assistant Examiner* — Brijesh V. Patel
(74) *Attorney, Agent, or Firm* — Bridgeway IP Law Group, PLLC; Sang Ho Lee; Hyun Woo Shin

(57) ABSTRACT

The present invention relates to a container including: a container body for accommodating a content therein; an outer cover rotating with respect to the container body to open and close the container body; and a hinge part for rotatably coupling the container body and the outer cover to each other, wherein the hinge part may include: a first rotating member having one side rotatably coupled to the container body and another side coupled to the outer cover; and a second rotating member having one side rotatably coupled to the outer container and another side coupled to the container body.

13 Claims, 7 Drawing Sheets

(56) References Cited

U.S. PATENT DOCUMENTS

| | | | | |
|---|---|---|---|---|
| 5,732,928 | A * | 3/1998 | Chang | H01H 13/84 248/676 |
| 6,526,989 | B2 * | 3/2003 | Sheffler | A45D 40/221 132/294 |
| 6,772,899 | B2 * | 8/2004 | Delmon | A45D 40/221 220/812 |
| 7,001,088 | B2 * | 2/2006 | Hui-hu | G06F 3/0208 400/681 |
| 7,089,627 | B2 * | 8/2006 | Seidler | B65D 51/04 206/823 |
| 7,314,051 | B2 * | 1/2008 | Yuhara | A45D 33/006 132/294 |
| 7,758,009 | B1 * | 7/2010 | Chang | A47B 23/044 248/456 |
| 8,005,522 | B2 * | 8/2011 | Ou | H04M 1/022 455/575.3 |
| 8,328,153 | B2 * | 12/2012 | Yang | F16M 11/10 248/370 |
| 9,185,954 | B2 * | 11/2015 | Cheung | H04B 1/3877 |
| 9,375,071 | B1 * | 6/2016 | Wang | A45D 33/22 |
| 9,452,873 | B2 * | 9/2016 | Eberlein | B65D 55/16 |
| 9,683,694 | B2 * | 6/2017 | Shiba | F16M 11/10 |
| 10,143,290 | B2 * | 12/2018 | Burditt | A45D 33/006 |
| 10,159,324 | B2 * | 12/2018 | Dinata | A45D 33/24 |
| 10,855,821 | B1 * | 12/2020 | Chou | H04B 1/3877 |
| 2004/0244812 | A1 | 12/2004 | Seidler et al. | |
| 2006/0283870 | A1 * | 12/2006 | Au | B65D 43/168 220/4.22 |
| 2007/0133156 | A1 * | 6/2007 | Ligtenberg | G06F 1/1616 361/679.3 |
| 2010/0072334 | A1 * | 3/2010 | Le Gette | F16M 11/10 29/428 |
| 2012/0227217 | A1 * | 9/2012 | Chen | G06F 1/1681 16/366 |
| 2014/0231304 | A1 * | 8/2014 | Lee | A45D 33/006 206/581 |
| 2014/0262854 | A1 * | 9/2014 | Chen | F16M 11/10 206/45.24 |
| 2015/0320174 | A1 * | 11/2015 | Kim | A47G 19/00 132/295 |
| 2016/0353857 | A1 * | 12/2016 | Kim | A45D 40/22 |
| 2017/0099930 | A1 * | 4/2017 | Kim | A45D 40/0075 |
| 2017/0336832 | A1 * | 11/2017 | Furlong | G01D 5/145 |
| 2018/0020810 | A1 * | 1/2018 | Eberlein | A45C 13/1069 132/315 |

FOREIGN PATENT DOCUMENTS

| | | | |
|---|---|---|---|
| JP | 0219767 | U | 2/1990 |
| JP | 2001253454 | A | 9/2001 |
| JP | 2005348886 | A | 12/2005 |
| JP | 2019522518 | A | 8/2019 |
| KR | 101378521 | B1 | 3/2014 |
| KR | 102043107 | B1 | 11/2019 |
| KR | 102089722 | B1 | 3/2020 |
| KR | 200494153 | Y1 | 8/2021 |

* cited by examiner (a)

(b)

CONTAINER WHOSE HINGE PART IS HIDDEN FROM OUTSIDE

CROSS REFERENCE TO RELATED APPLICATION OF THE INVENTION

The present application claims the priority of Korean Patent Application No. 10-2021-0087839 filed in the Korean Intellectual Property Office on Jul. 5, 2021, the entire contents of which are incorporated herein by reference.

BACKGROUND OF THE INVENTION

Field of the Invention

The present invention relates to a container, and more specifically, to a container whose hinge part is hidden from the outside that is capable of operating conveniently and providing a simple outer appearance.

Background of the Related Art

Generally, a compact container includes a container body for accommodating a content therein, a cover for opening and closing the container body, and a hinge part for rotatably coupling the container body and the cover to each other. The compact container is configured to allow the cover to be rotatably coupled to one side of the container body, and accordingly, the cover is not separated from the container body, so that advantageously, there is no need to additionally grasp the cover, and a mirror is mounted on the inside of the cover.

In this case, however, the hinge part as a necessary component of the container is exposed to the outside of the container, so that the outer peripheral surfaces of the container body and the cover may not be sophisticatedly formed to make an outer appearance of the container to be deteriorated badly.

To solve such problems, a structure in which the hinge part is disposed inside the container, without being exposed to the outside, has been developed, but in this case, the radius of rotation of the hinge part becomes limitedly made due to the tight contact between the container body and the cover. Further, the number of components for the hinge part may be undesirably increased to cause the container to be complicated in configuration.

SUMMARY OF THE INVENTION

Accordingly, the present invention has been made in view of the above-mentioned problems occurring in the related art, and it is an object of the present invention to provide a container that is capable of allowing a hinge part to be disposed therein, without being exposed to the outside, thereby providing a simple outer appearance thereof.

To accomplish the above-mentioned object, according to the present invention, there is provided a container including: a container body for accommodating a content therein; an outer cover rotating with respect to the container body to open and close the container body; and a hinge part for rotatably coupling the container body and the outer cover to each other, wherein the hinge part may include: a first rotating member having one side rotatably coupled to the container body and another side coupled to the outer cover; and a second rotating member having one side rotatably coupled to the outer cover and another side coupled to the container body.

According to the present invention, desirably, the first rotating member and the second rotating member may be disposed at inside of the container body and the outer cover, without being exposed to the outside.

According to the present invention, desirably, the first rotating member and the second rotating member may be rotatably coupled to each other.

According to the present invention, desirably, the first rotating member may include: a first hinge shaft rotatably coupled to the container body; and a first hinge arm extending from the first hinge shaft, and the second rotating member may include: a second hinge shaft rotatably coupled to the outer cover; and a second hinge arm extending from the second hinge shaft.

According to the present invention, desirably, the first rotating member may include a first guide protrusion protruding outward from an end portion of the first hinge arm, the second rotating member may include a second guide protrusion protruding outward from an end portion of the second hinge arm, the outer cover may include a first guide groove in which the first guide protrusion is inserted, and the container body may include a second guide groove in which the second guide protrusion is inserted.

According to the present invention, desirably, the first guide groove may be formed to have a given length in a vertical direction with respect to the outer cover, and the second guide groove may be formed to have a given length in a vertical direction to the container body.

According to the present invention, desirably, the first hinge arm may be curved to a given angle at a first curved portion, and the second hinge arm may be curved to a given angle at a second curved portion.

According to the present invention, desirably, a first hinge connector may be disposed on one side of the first hinge arm, and a second hinge connector may be disposed on one side of the second hinge arm, and as the first hinge connector and the second hinge connector are connected to each other, the first hinge arm and the second hinge arm may be rotatably coupled to each other.

According to the present invention, desirably, a first magnetic member may be disposed on one side of the container body, and a second magnetic member may be disposed on one side of the outer cover, and through a magnetic force between the first magnetic member and the second magnetic member, the outer cover and the container body may be coupled to each other.

According to the present invention, desirably, the container body may include: an inner container for accommodating the content therein; and an outer container coupled to outside of the inner container, and of which the first rotating member to be coupled to one side.

According to the present invention, desirably, the inner container may be detachably coupled to the outer container.

According to the present invention, desirably, the inner container may include: an accommodation portion for accommodating the content therein; and an inner cover rotatably coupled to the accommodation portion by a third rotating member.

According to the present invention, desirably, the inner container may include a covering member disposed on upper side of the third rotating member, and configured to cover the third rotating member at the upper side.

According to the present invention, desirably, an insertion portion which is recessed downward may be disposed on a portion of an upper surface of the outer container, and the third rotating member may be inserted into the insertion portion, and a space may be formed between the outer container and the third rotating member.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
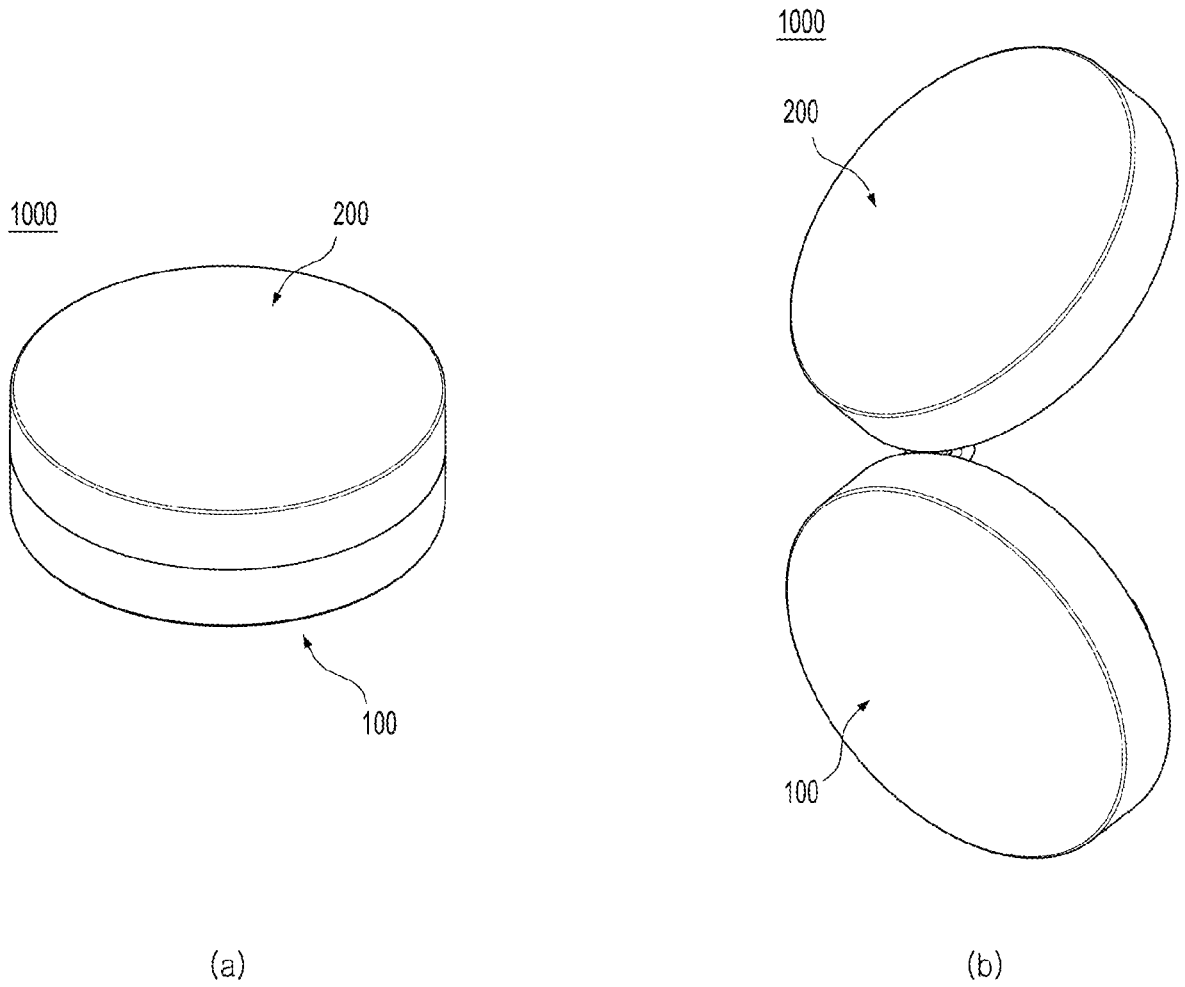
FIG. 1 is perspective view showing a container according to the present invention.

Hereinafter, the present invention is disclosed with reference to the attached drawings wherein the corresponding parts in the embodiments of the present invention are indicated by corresponding reference numerals and the repeated explanation on the corresponding parts will be avoided. In the description, every direction as will be described later may be determined with respect to the drawings, and therefore, they should be not necessarily defined on the basis of the whole scope of the present invention.

Terms, such as the first, the second, A, and B, may be used to describe various elements, but the elements should not be restricted by the terms. The terms are used to only distinguish one element from the other element. For example, a first element may be named a second element without departing from the scope of the present invention. Likewise, a second element may be named a first element. A term 'and/or' includes a combination of a plurality of relevant and described items or any one of a plurality of related and described items.

Terms used in this application are used to only describe specific exemplary embodiments and are not intended to restrict the present invention. An expression referencing a singular value additionally refers to a corresponding expression of the plural number, unless explicitly limited otherwise by the context. In this application, terms, such as "comprise", "include", or "have", are intended to designate those characteristics, numbers, steps, operations, elements, or parts which are described in the specification, or any combination of them that exist, and it should be understood that they do not preclude the possibility of the existence or possible addition of one or more additional characteristics, numbers, steps, operations, elements, or parts, or combinations thereof.

When it is said that one element is described as being "connected" or "coupled" to the other element, one element may be directly connected or coupled to the other element, but it should be understood that another element may be present between the two elements. Further, when it is said that one portion is described as "includes" any component, one element further may include other components unless no specific description is suggested.

Figure 2:
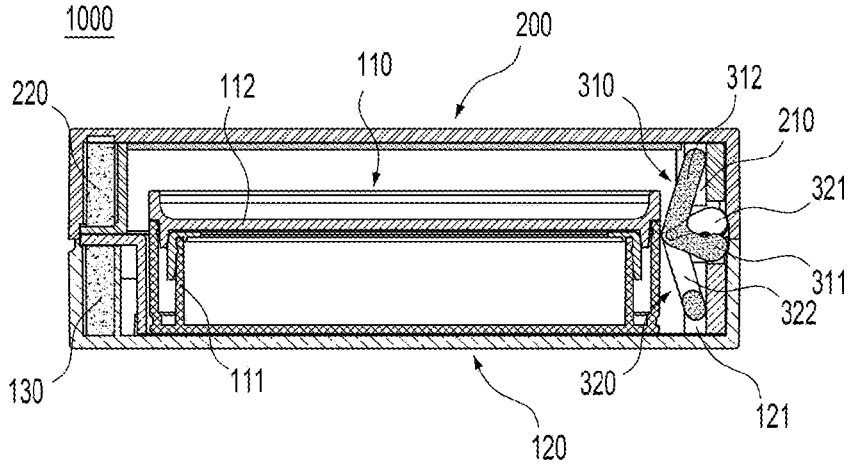
FIG. 2 is sectional view showing the container according to the present invention.
Figure 2:
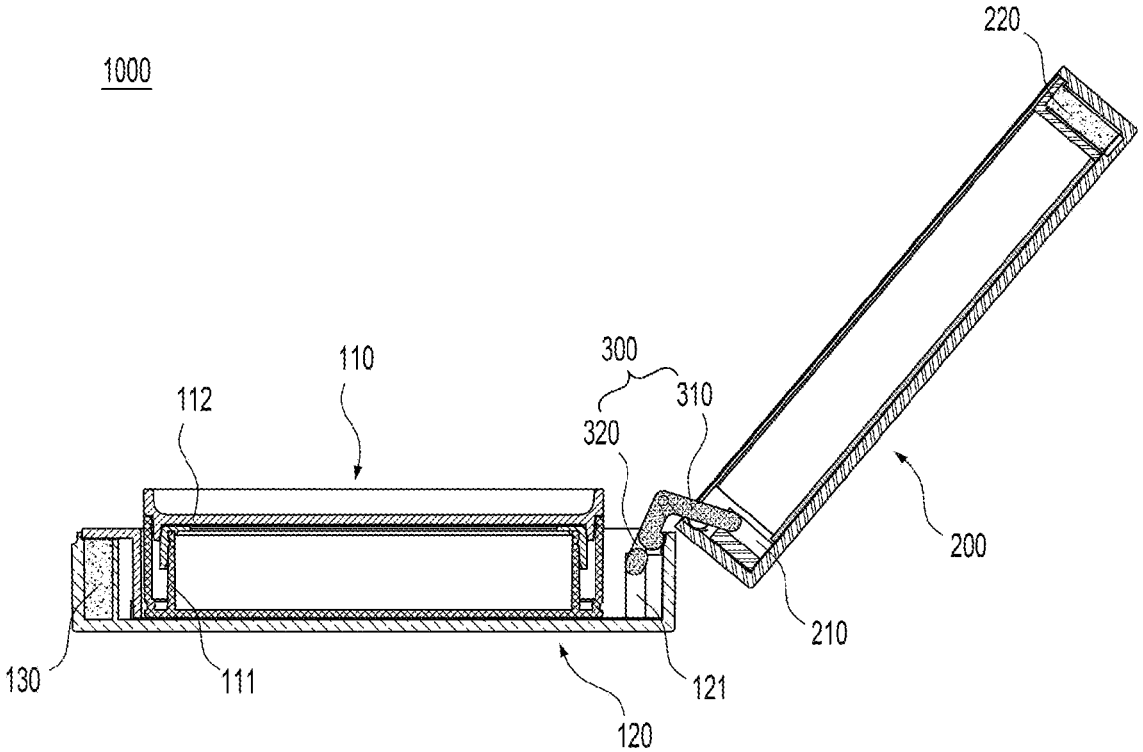
Figure 3:
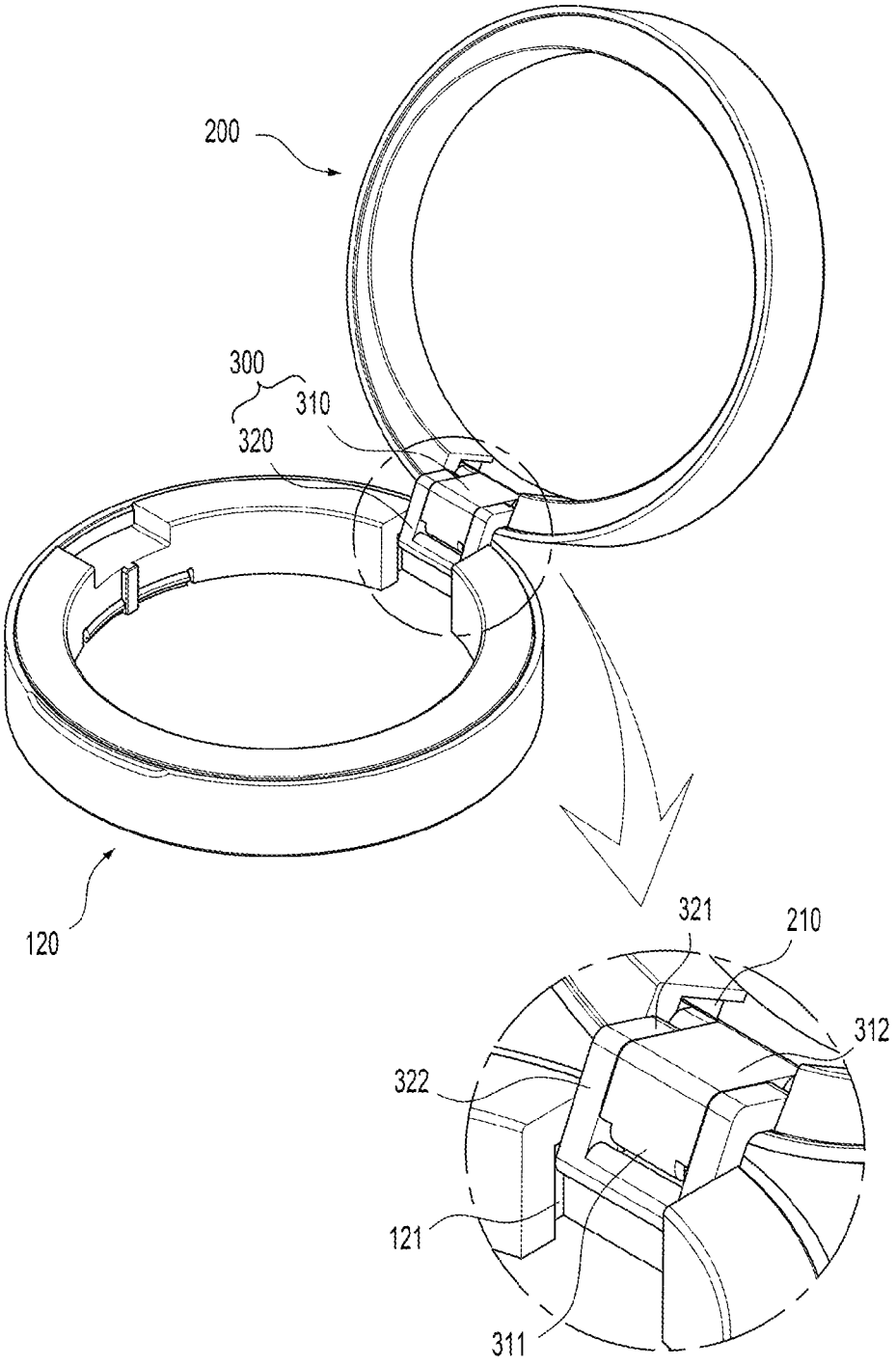
FIG. 3 is a perspective view showing an outer container and an outer cover of the container according to the present invention.
Figure 4:
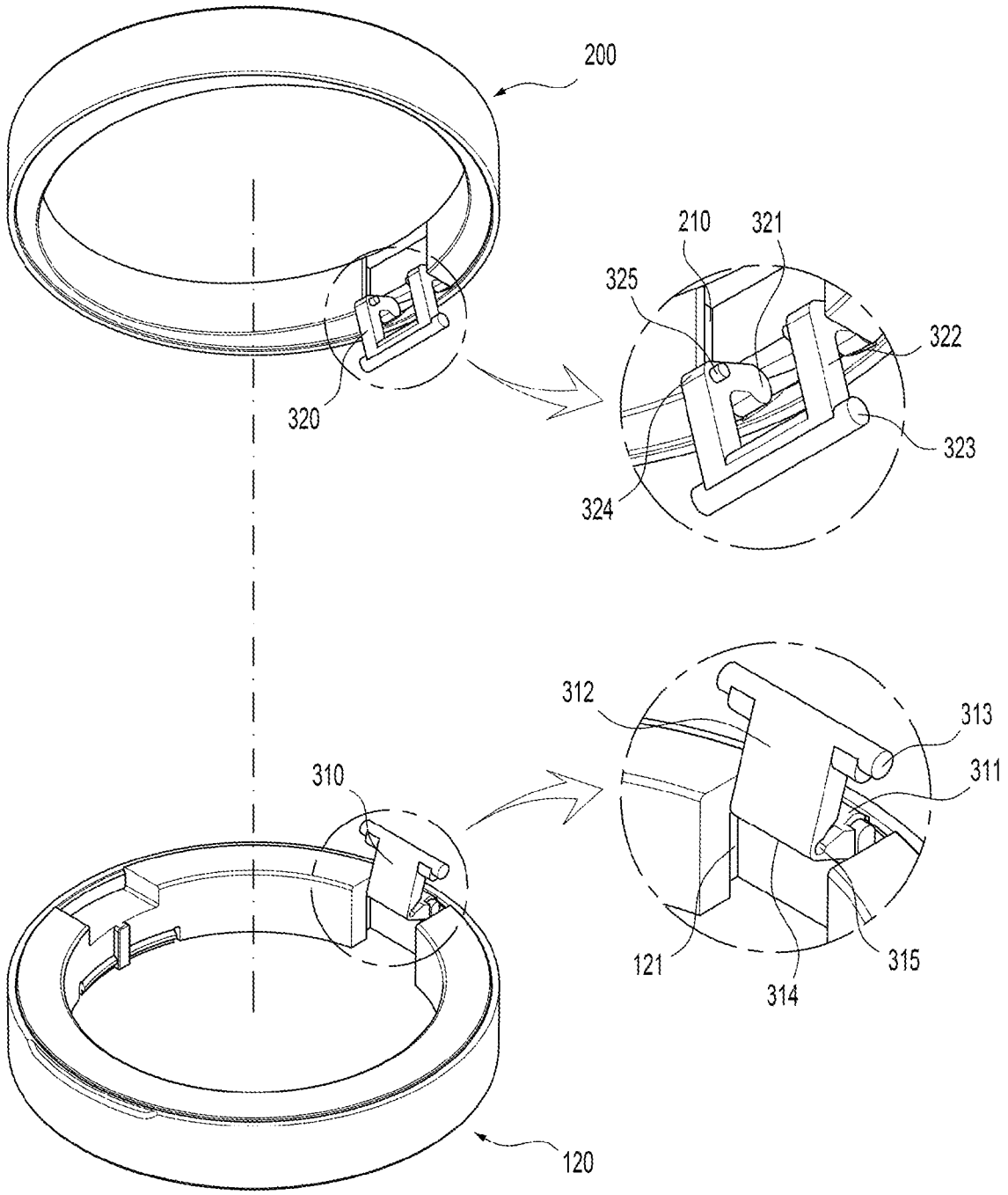
FIG. 4 is an exploded perspective view showing the outer container and the outer cover of the container according to the present invention.

FIG. 1 is perspective view showing a container according to the present invention, FIG. 2 is sectional view showing the container according to the present invention, FIG. 3 is a perspective view showing an outer container and an outer cover of the container according to the present invention, and FIG. 4 is an exploded perspective view showing the outer container and the outer cover of the container according to the present invention. In detail, (a) of FIG. 1 and (a) of FIG. 2 show the state where the container is closed, and (b) of FIG. 1 and (b) of FIG. 2 show the state where the container is open.

As shown in FIGS. 1 to 4, a container 1000 according to a first embodiment of the present invention may include a container body 100, an outer cover 200, and a hinge part 300.

The container body 100 may be adapted to accommodate a content therein. In this case, the content may be a liquid, gel, or powder type cosmetic material. For example, the content may include lotion, milk lotion, moisturizing lotion, nourishing lotion, skin lotion, skin softener, skin toner, astringent toner, massage cream, nourishing cream, moisture cream, whitening essence, tone-up cream, sun block, sun cream, sun milk, BB cream, base, foundation, CC cream, concealer, blusher, shade, eye shadow, eyebrow, eye cream, primer, and the like. However, the content is not limited necessarily thereto, and it may include cosmetic materials, medical contents, and the like, which have different forms and types from the above-mentioned contents. The content may be filled in the accommodation space of the container body 100 directly or through a sponge-like impregnation member, a cosmetic plate, and the like.

According to the embodiment, the container body 100 may have at least one accommodation space for accommodating the content therein. If a plurality of accommodation spaces are formed in the container body 100, they may accommodate the same content as one another or different contents from one another. The accommodation space may be open on top thereof.

According to the embodiment, the container body 100 may be a single container having one container, and otherwise, the container body 100 may be a double container having an inner container 110 and an outer container 120. In a case in which the container body 100 is the double container having the inner container 110 and the outer container 120, the content may be accommodated in the inner container 110, and the inner container 110 may be inserted inside the outer container 120. For the brevity of the description, an explanation of the insertion of the inner container 110 into the outer container 120 will be given later with reference to FIGS. 5 to 7.

The outer cover 200 may rotate with respect to the container body 100 to open and close the container body 100. According to the embodiment, the outer cover 200 may rotate with respect to the container body 100 by means of the hinge part 300, and while the content is being not used, the outer cover 200 may be coupled to the container body 100 by means of locking members 130 and 220 to thus keep the sealed state from the container body 100.

The hinge part 300 may be adapted to rotatably couple the outer cover 200 and the container body 100 to each other. In this case, the hinge part 300 may be disposed at the insides of the container body 100 and the outer cover 200. As the hinge part 300 is disposed at the insides of the container body 100 and the outer cover 200, it may be not exposed to outside. In the case of the conventional container having the hinge part, the hinge part is exposed to the outside, and accordingly, one surface of the container body 100 or the outer cover 200 is concavely or protrudingly formed, thereby failing to provide a good outer appearance of the container. According to the present invention, however, the hinge part 300 is not exposed to the outside of the container 1000, and accordingly, the outer peripheral surface of the container 1000 may be sophisticatedly formed, thereby providing a simple outer appearance of the container 1000.

According to the embodiment, the hinge part 300 may include a first rotating member 310 and a second rotating member 320.

The first rotating member 310 may have one side rotatably coupled to the container body 100 (especially, the outer container 120) and another side coupled to the outer cover 200. Further, the second rotating member 320 may have one side rotatably coupled to the outer cover 200 and another side coupled to the container body 100 (especially, the outer container 120). Accordingly, the first rotating member 310 may be adapted to rotate the outer cover 200 with respect to the container body 100, and the second rotating member 320 to rotate the container body 100 with respect to the outer cover 200. As the outer cover 200 rotates with respect to the container body 100 and the container body 100 rotates with respect to the outer cover 200, the rotation may be doubly performed, thereby achieving stable rotation.

According to the embodiment, the first rotating member 310 may include a first hinge shaft 311 rotatably coupled to the container body 100 (especially, the outer container 120) and a first hinge arm 312 extending from the first hinge shaft 311. Further, the second rotating member 320 may include a second hinge shaft 321 rotatably coupled to the outer cover 200 and a second hinge arm 322 extending from the second hinge shaft 321. The first hinge arm 312 may be coupled to the outer cover 200 to allow the outer cover 200 to rotate with respect to the first hinge shaft 311, and the second hinge arm 322 may be coupled to the container body 100 to allow the container body 100 to rotate with respect to the second hinge shaft 321.

According to the embodiment, the first rotating member 310 may include a first guide protrusion 313 protruding outward from an end portion of the first hinge arm 312. Further, the second rotating member 320 may include a second guide protrusion 323 protruding outward from an end portion of the second hinge arm 322. In this case, the outer cover 200 may include a first guide groove 210 in which the first guide protrusion 313 is inserted. Further, the container body 100 may include a second guide groove 121 in which the second guide protrusion 323 is inserted. As the first guide protrusion 313 is inserted into the first guide groove 210, the outer cover 200 is coupled to the first rotating member 310, so that the first rotating member 310 may rotate the outer cover 200 with respect to the container body 100. As the second guide protrusion 323 is inserted into the second guide groove 121, further, the container body 100 is coupled to the second rotating member 320, so that the second rotating member 320 may rotate the container body 100 with respect to the outer cover 200.

According to the embodiment, the first guide groove 210 and/or the second guide groove 121 may be formed to have a given length. When the first rotating member 310 rotates with respect to the container body 100 to thus rotate the outer cover 200, the first guide protrusion 313 may move along the first guide groove 210 in a state of being inserted into the first guide groove 210 and allow the radius of rotation of the outer cover 200 with respect to the container body 100 to be varied. When the second rotating member 320 rotates with respect to the outer cover 200 to thus rotate the container body 100, further, the second guide protrusion 323 may move along the second guide groove 121 in a state of being inserted into the second guide groove 121 and allow the radius of rotation of the container body 100 with respect to the outer cover 200 to be varied.

For example, when the first guide protrusion 313 is disposed at upper end of the first guide groove 210, the radius of rotation of the outer cover 200 with respect to the container body 100 may become minimum, and when the first guide protrusion 313 is disposed at lower end of the first guide groove 210, the radius of rotation of the outer cover 200 with respect to the container body 100 may become maximum. Further, when the second guide protrusion 323 is disposed at lower end of the second guide groove 121, the radius of rotation of the container body 100 with respect to the outer cover 200 may become minimum, and when the second guide protrusion 323 is disposed at upper end of the second guide groove 121, the radius of rotation of the container body 100 with respect to the outer cover 200 may become maximum.

In the case of the conventional container having the hinge part, the radius of rotation of the hinge part is constantly kept, and if the hinge part is disposed inside the container, accordingly, the tight contact between the container body and the cover enables the rotation of the hinge part to be limitedly made, thereby failing to allow the cover to open and close the container body. According to the present invention, contrarily, if it is desired to rotate the outer cover 200 with respect to the container body 100 to thus open the container body 100, the first rotating member 310 and the second rotating member 320 may move along the first guide groove 210 and the second guide groove 121, respectively, to gradually increase the radiuses of rotations of the outer cover 200 and the container body 100, so that even though the hinge part 300 is disposed inside the container 1000, the container body 100 and the outer cover 200 do not come into contact with each other through the increase of the radiuses of rotations, while rotating by means of the hinge part 300, thereby having no limitation in their rotation. In the same manner as above, if it is desired to rotate the outer cover 200 with respect to the container body 100 to thus close the container body 100, the first rotating member 310 and the second rotating member 320 may move along the first guide groove 210 and the second guide groove 121, respectively, to gradually decrease the radiuses of rotations of the outer cover 200 and the container body 100, so that when the outer cover 200 rotates to the maximum and closes the container body 100, the radius of rotation of the outer cover 200 may become minimum to thus allow the outer cover 200 to come into close contact with the container body 100.

According to the embodiment, the first guide groove 210 may be formed to have a given length in a vertical direction with respect to the outer cover 200, and the second guide groove 121 may be formed to have a given length in a vertical direction with respect to the container body 100 (especially, the outer container 120). Accordingly, the spaces occupied by the first guide groove 210 and the second guide groove 121 on the outer cover 200 and the container body 100 can be minimized, thereby decreasing the size of the container 1000. However, the lengths of the first guide groove 210 and the second guide groove 121 may not be limited necessarily thereto.

According to the embodiment, the first guide groove 210 and/or the second guide groove 121 may be adjusted in length to control the degrees of rotations of the container body 100 and the outer cover 200. As the degrees of rotations of the container body 100 and the outer cover 200 are controlled, the angle between the container body 100 and the outer cover 200 may be adjusted upon the maximum rotations of the container body 100 and the outer cover 200. In specific, when the first guide groove 210 and/or the second guide groove 121 are increased in length, the moving distances of the first rotating member 310 and/or the second rotating member 320 along the first guide groove 210 and/or the second guide groove 121 become long, and upon the rotations of the container body 100 and the outer cover 200, accordingly, the changes in the radiuses of rotations become big. When the changes in the radiuses of rotations of the container body 100 and the outer cover 200 are big, the degrees of rotations of the container body 100 and the outer cover 200 become increased, so that upon the maximum rotations of the container body 100 and the outer cover 200, the angle between the container body 100 and the outer cover 200 becomes increased. Contrarily, if the first guide groove 210 and/or the second guide groove 121 are decreased in length, the moving distances of the first rotating member 310 and/or the second rotating member 320 along the first guide groove 210 and/or the second guide groove 121 become short, and upon the rotations of the container body 100 and the outer cover 200, accordingly, the changes in the radiuses of rotations become small. When the changes in the radiuses of rotations of the container body 100 and the outer cover 200 are small, the degrees of rotations of the container body 100 and the outer cover 200 become decreased, so that upon the maximum rotations of the container body 100 and the outer cover 200, the angle between the container body 100 and the outer cover 200 becomes decreased.

According to the embodiment, the first rotating member 310 may be curved to a given angle at a first curved portion 314. Further, the second rotating member 320 may be curved to a given angle at a second curved portion 324. If the first rotating member 310 and the second rotating member 320 are linearly formed, without being curved, when they are disposed inside the container 1000, they come into contact with the container body 100 and the outer cover 200, respectively, to limit their outward movement, thereby causing the limitation in the rotations. According to the present invention, the first rotating member 310 and the second rotating member 320 are curved to the given angles at the first curved portion 314 and the second curved portion 324, respectively, and even though they are disposed inside the container 1000, they do not come into contact with the container body 100 and the outer cover 200, respectively, while the outer cover 200 and the container body 100 being rotating, thereby permitting the rotations of the outer cover 200 and the container body 100.

According to the embodiment, the first rotating member 310 and the second rotating member 320 may be connectable to each other. As the first rotating member 310 and the second rotating member 320 are connected to each other, they may be rotatably coupled to each other. Accordingly, the first rotating member 310 and the second rotating member 320 may stably support against each other. Further, the rotation through the first rotating member 310 and the rotation through the second rotating member 320 interlock with each other, and accordingly, the opening and closing rotations of the container body 100 and the outer cover 200 may be achieved gently and stably.

According to the embodiment, the first rotating member 310 and the second rotating member 320 may be laid on top of each other, and in this case, the first rotating member 310 may be located inside the second rotating member 320 and coupled to the second rotating member 320. Without being limited necessarily thereto, however, the second rotating member 320 may be located inside the first rotating member 310 and coupled to the first rotating member 310.

According to the embodiment, the first rotating member 310 may include a first hinge connector 315, and the second rotating member 320 may include a second hinge connector 325. As the first hinge connector 315 and the second hinge connector 325 are connected to each other, the first rotating member 310 and the second rotating member 320 may be rotatably coupled to each other. For example, the first hinge connector 315 may be formed at one side of the first hinge arm 312, and the second hinge connector 325 at one side of the second hinge arm 322. Further, for example, the first hinge connector 315 may have the shape of a fitting protrusion protruding from one side of the first hinge arm 312, and the second hinge connector 325 may have the shape of a fitting groove concavely formed at one side of the second hinge arm 322, so that the first hinge connector 315 may be fittedly coupled to the second hinge connector 325. However, of course, the first hinge connector 315 and the second hinge connector 325 may have the shapes of a fitting groove and a fitting protrusion, respectively, without being limited necessarily thereto. Otherwise, other coupling structures capable of rotatably coupling the first rotating member 310 and the second rotating member 320 to each other may be adopted.

According to the embodiment, the first hinge connector 315 may be formed at the first curved portion 314, and the second hinge connector 325 at the second curved portion 324. As a result, the first rotating member 310 and the second rotating member 320 may be rotatably coupled to each other at the first hinge connector 315 and the second hinge connector 325.

According to the embodiment, the locking members 130 and 220 may include a first magnetic member 130 and a second magnetic member 220. In specific, the first magnetic member 130 may be disposed at one side of the container body 100 (especially, the outer container 120), and the second magnetic member 220 at one side of the outer cover 200. Through a magnetic force between the first magnetic member 130 and the second magnetic member 220, the outer cover 200 and the container body 100 may be coupled to each other. In this case, the first magnetic member 130 may be built in one side of the container body 100 (especially, the outer container 120), and the second magnetic member 220 in one side of the outer cover 200, so that the first magnetic member 130 and the second magnetic member 220 may be not exposed to the outside. Accordingly, the container 1000 may be configured to have the locking members 130 and 220 as well as the hinge part 300 hidden therein, thereby providing the simpler outer appearance of the container 1000. However, the locking members 130 and 220 are not limited necessarily to such structures, and they may have different locking structures capable of keeping the coupled state between the container body 100 and the outer cover 200.

The container 1000 as shown in FIGS. 1 to 4 is just exemplary, and accordingly, it may be freely configured according to various embodiments of the present invention.

Figure 5:
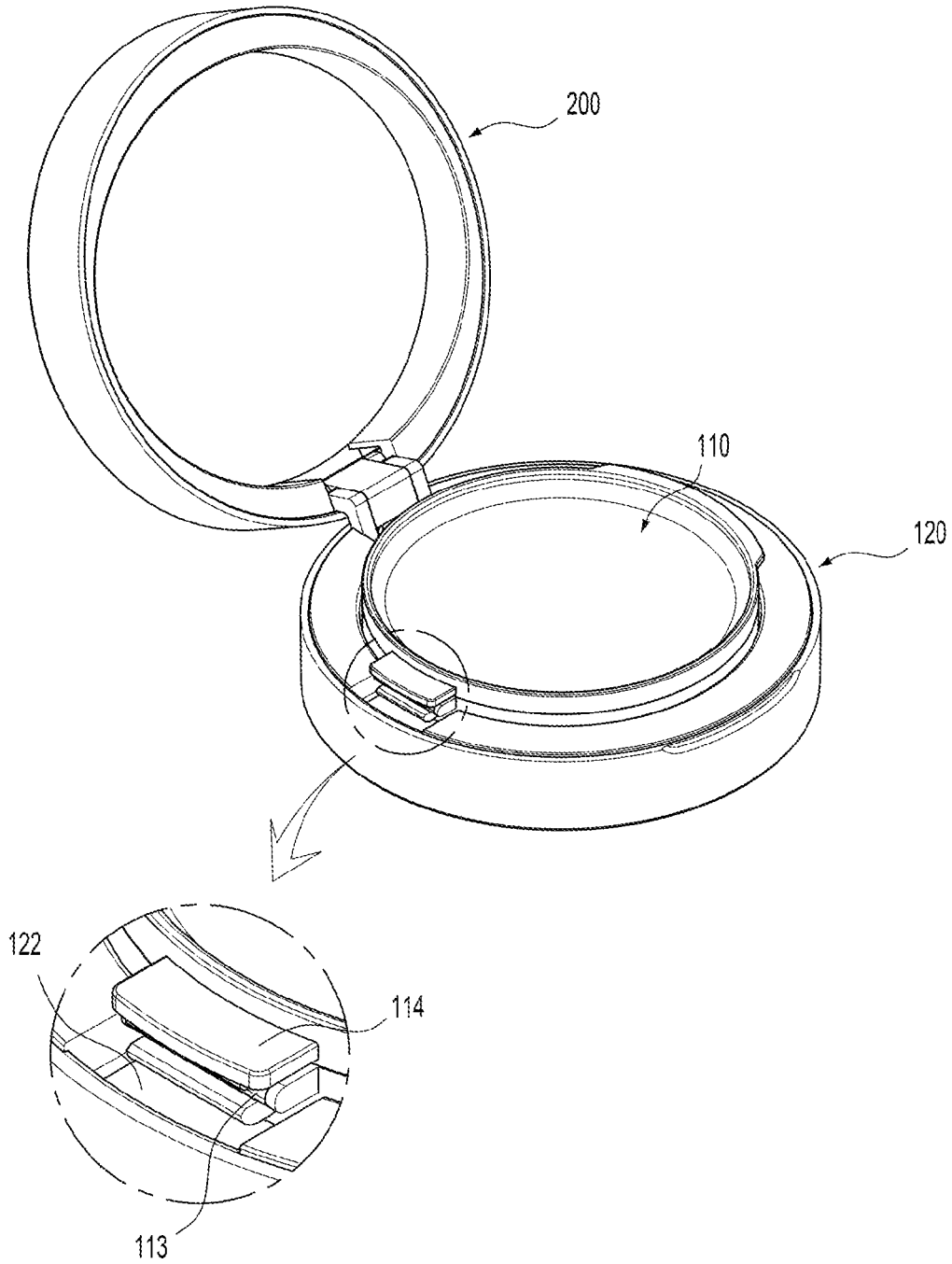
FIG. 5 is a perspective view showing the container according to the present invention.
Figure 6:
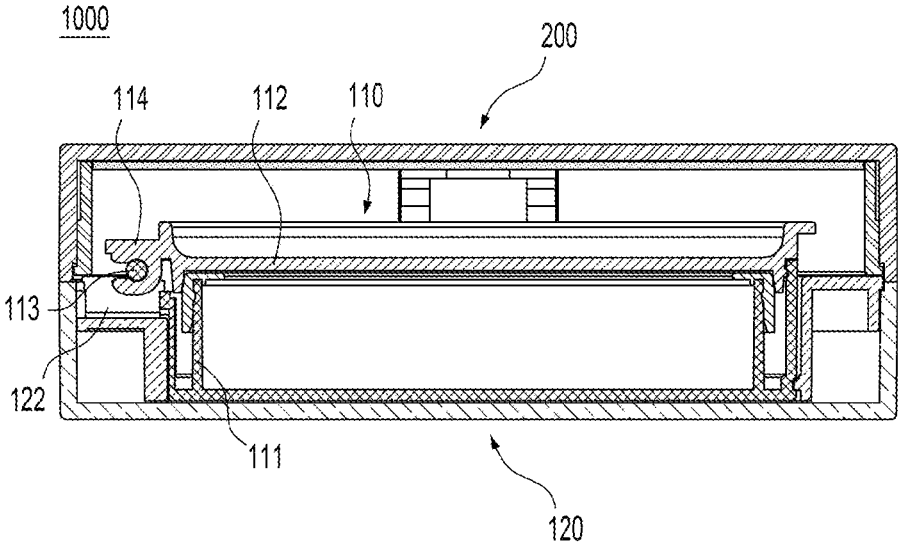
FIG. 6 is a sectional view showing the container according to the present invention.
Figure 7:
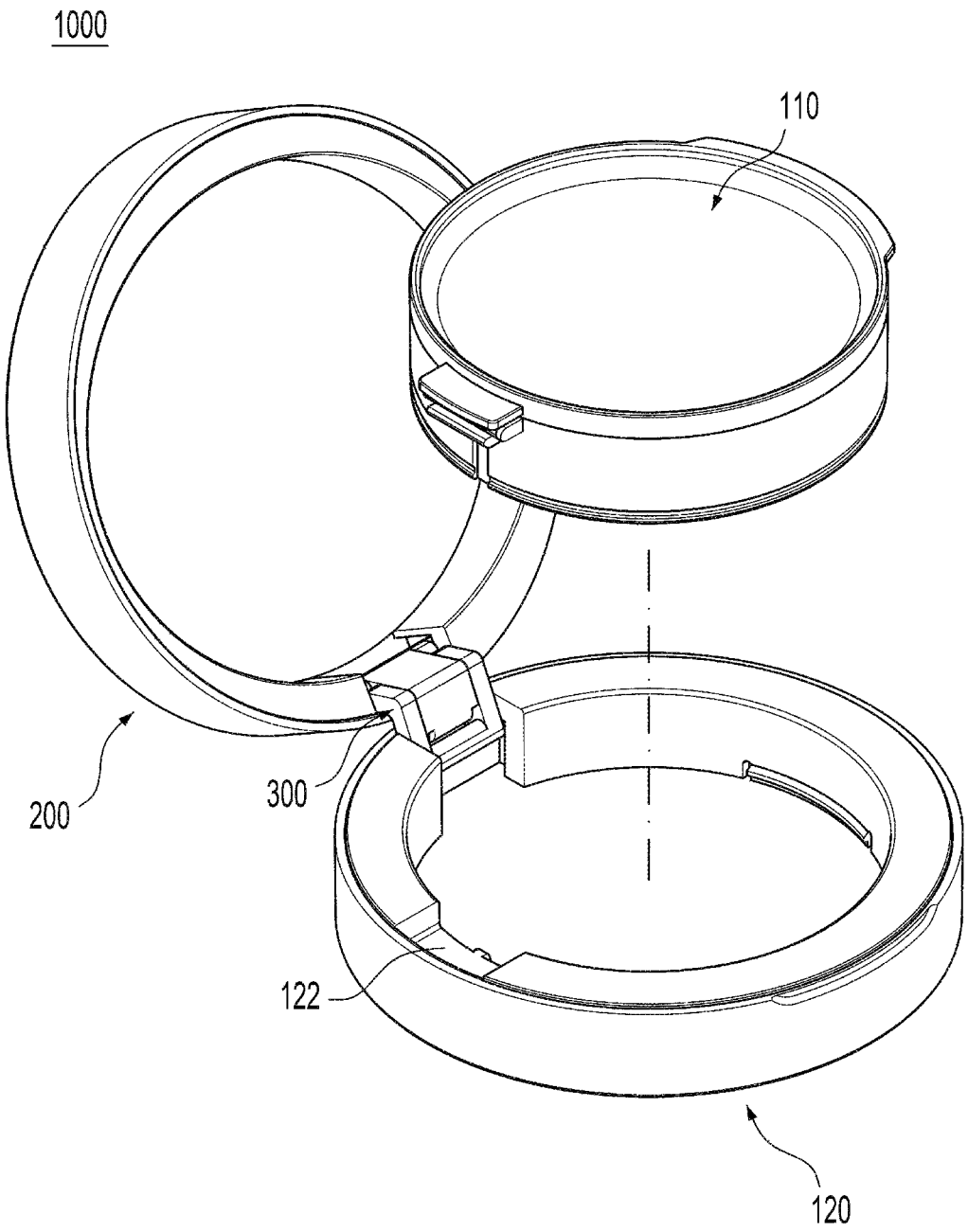
FIG. 7 is an exploded perspective view showing the container according to the present invention.

FIG. 5 is a perspective view showing the container according to the present invention, FIG. 6 is a sectional view showing the container according to the present invention, and FIG. 7 is an exploded perspective view showing the container according to the present invention.

Referring to FIGS. 5 to 7, the container body 100 may include the inner container 110 and the outer container 120.

According to the embodiment, the inner container 110 may include an accommodation portion 111 for accommodating the content therein and an inner cover 112 rotatably coupled to the accommodation portion 111. The inner cover 112 may rotate with respect to the accommodation portion 111 to open and close the accommodation portion 111. In this case, the inner cover 112 may rotate by means of a third rotating member 113 disposed at one side of the accommodation portion 111.

According to the embodiment, the accommodation portion 111 may include a base portion, an inner peripheral wall extending upward from the base portion, and an outer peripheral wall extending upward from the base portion, while being spaced apart from the inner peripheral wall by a given distance. The content may be accommodated in the space formed by the base portion and the inner peripheral wall.

According to the embodiment, an escape prevention member is seated onto top of the accommodation portion 111 (especially, the inner peripheral wall). At least a portion of the escape prevention member may coupledly surround the top end periphery of the accommodation portion 111 (especially, the inner peripheral wall), while protruding outward therefrom toward the inner peripheral surface of the accommodation portion 111. Accordingly, the escape prevention member may prevent the content (especially, an impregnation member into which the content is impregnated) stored in the accommodation portion 111 from escaping therefrom to the outside.

According to the embodiment, the inner cover 112 may have a locking protrusion protruding downward from the underside periphery thereof. The locking protrusion may be inserted into the space between the inner peripheral wall and the outer peripheral wall of the accommodation portion 111 so that it may come into close contact with the inner peripheral wall (and/or the escape prevention member) and/or the outer peripheral wall of the accommodation portion 111, thereby coupling the inner cover 112 to the accommodation portion 111. For example, the locking protrusion may extend downward from the underside periphery of the inner cover 112, but without being limited necessarily thereto, only if the inner cover 112 is coupled to the accommodation portion 111, various locking structures may be adopted.

According to the embodiment, the inner container 110 may include a covering member 114. The covering member 114 may be disposed on upper side of the third rotating member 113 to cover the third rotating member 113. To cover the third rotating member 113 at the upper side, the covering member 114 may extend outward from the outer peripheral surface of the inner cover 112 to have given width and length corresponding to the width and length of the third rotating member 113, while being disposed at top of the third rotating member 113. Without being limited necessarily thereto, however, only if the covering member 114 covers the third rotating member 113 on top of the third rotating member 113, it may be freely configured. In addition to the hinge part 300 not exposed to the outside, according to the present invention, when the outer cover 200 rotates to open, the third rotating member 113 of the inner container 110 may be not exposed to top of the container body 100, thereby providing simpler outer appearance of the container 1000.

According to the embodiment, the inner container 110 may be detachably coupled to the outer container 120. To do this, a structure in which the inner container 110 may be detachably coupled to the outer container 120 is provided. For example, the inner container 110 and/or the outer container 120 may have at least one coupling protrusion and/or coupling groove, and without being limited necessarily thereto, various coupling structures for detachable coupling, such as screw coupling, and the like may be adopted.

According to the embodiment, the outer container 120 may have an insertion portion 122 recessed downward from a portion of the upper surface thereof. The third rotating member 113 may be inserted into the insertion portion 122. Through the formation of the insertion portion 122, a space may be formed between the outer container 120 and the third rotating member 113. In specific, the side periphery and the underside periphery of the third rotating member 113 may be spaced apart from top of the outer container 120 by given distances, respectively, by means of the insertion portion 122. As the space is formed, a user's finger may be put into the space to lift up the inner container 110 so that the inner container 110 may be simply separated from the outer container 120. For example, when the content stored in the inner container 110 is consumed up, the user may separate the inner container 110 from the outer container 120 and insert a new inner container 110 into the outer container 120, so that he or she can keep using the outer container 120.

The container 1000 as shown in FIGS. 5 to 7 is just exemplary, and accordingly, it may be freely configured according to various embodiments of the present invention.

As described above, the container according to the present invention is configured to have the hinge part not exposed to the outside, so that the outer peripheral surface of the container is sophisticatedly formed, thereby providing a simple outer appearance of the container.

Further, the container according to the present invention is configured to have the hinge part simple in configuration and with a relatively small number of components, thereby ensuring a simple manufacturing process and a low manufacturing cost.

Also, the container according to the present invention is configured to allow the radiuses of rotations of the container body and the outer cover to be varied through the rotation of the hinge part, so that even while the hinge part is being disposed inside the container body, the container body and the outer cover can rotate, without being limited in their radiuses of rotations.

Moreover, the container according to the present invention is configured to allow the given space to be formed between the outer container and the rotating member of the inner container, so that the user's finger is put into the space to lift up the inner container, thereby simply separating the inner container from the outer container.

The present invention may be modified in various ways and may have several exemplary embodiments. Terms used in this application are used to only describe specific exemplary embodiments and are not intended to restrict the present invention. Accordingly, it should be understood that the invention covers all the modifications, equivalents, and replacements within the idea and technical scope of the invention. Therefore, the present invention is not to be restricted by the embodiment but only by the appended claims.

What is claimed is:

1. A container comprising:

a container body for accommodating a content therein;

an outer cover rotating with respect to the container body to open and close the container body; and a hinge part for rotatably coupling the container body and the outer cover to each other, wherein the hinge part comprises:

a first rotating member having one side rotatably coupled to the container body and another side coupled to the outer cover; and a second rotating member having one side rotatably coupled to the outer cover and another side coupled to the container body, and wherein the container body comprises:

an inner container for accommodating the content therein; and an outer container coupled to an outside of the inner container, wherein the first rotating member is coupled to one side of the outer container.

2. The container according to claim 1, wherein the first rotating member and the second rotating member are disposed inside of the container body and the outer cover, without being exposed to an outside of the container.

3. The container according to claim 1, wherein the first rotating member and the second rotating member are rotatably coupled to each other.

4. The container according to claim 1, wherein the first rotating member comprises:

a first hinge shaft rotatably coupled to the container body; and a first hinge arm extending from the first hinge shaft, and wherein the second rotating member comprises:

a second hinge shaft rotatably coupled to the outer cover; and a second hinge arm extending from the second hinge shaft.

5. The container according to claim 4, wherein the first rotating member further comprises a first guide protrusion protruding outward from an end portion of the first hinge arm, wherein the second rotating member further comprises a second guide protrusion protruding outward from an end portion of the second hinge arm, wherein the outer cover comprises a first guide groove in which the first guide protrusion is inserted, and wherein the container body comprises a second guide groove in which the second guide protrusion is inserted.

6. The container according to claim 5, wherein the first guide groove has a given length in a vertical direction to the outer cover, and the second guide groove has a given length in a vertical direction to the container body.

7. The container according to claim 4, wherein the first hinge arm is curved to a given angle at a first curved portion, and the second hinge arm is curved to a given angle at a second curved portion.

8. The container according to claim 4, wherein a first hinge connector is disposed on one side of the first hinge arm, and a second hinge connector is disposed on one side of the second hinge arm, and wherein the first hinge connector and the second hinge connector are connected to each other, and the first hinge arm and the second hinge arm are rotatably coupled to each other.

9. The container according to claim 1, wherein a first magnetic member is disposed on one side of the container body, and a second magnetic member is disposed on one side of the outer cover, and wherein through a magnetic force between the first magnetic member and the second magnetic member, the outer cover and the container body are coupled to each other.

10. The container according to claim 1, wherein the inner container is detachably coupled to the outer container.

11. The container according to claim 1, wherein the inner container comprises:

an accommodation portion for accommodating the content therein; and an inner cover rotatably coupled to the accommodation portion by a third rotating member.

12. The container according to claim 11, wherein the inner container comprises a covering member disposed on an upper side of the third rotating member, and the covering member is configured to cover the third rotating member at the upper side thereof.

13. The container according to claim 11, wherein an insertion portion which is recessed downward is disposed on a portion of an upper surface of the outer container, and wherein the third rotating member is inserted into the insertion portion, and a space is formed between the outer container and the third rotating member.

* * * * *